United States Patent [19]

Lehmann et al.

[11] 4,238,049

[45] Dec. 9, 1980

[54] BOX-TYPE TRANSPORT CONTAINER OF AN ELECTRICALLY DRIVEN TRANSPORT CAR WITH A LOCKABLE COVER

[75] Inventors: Herbert Lehmann; Kurt Tutas, both of Berlin, Fed. Rep. of Germany

[73] Assignee: Siemens Aktiengesellschaft, Berlin & Munich, Fed. Rep. of Germany

[21] Appl. No.: 29,394

[22] Filed: Apr. 12, 1979

[30] Foreign Application Priority Data

Apr. 14, 1978 [DE] Fed. Rep. of Germany ..... 2816894

[51] Int. Cl.[3] ..... B65D 43/14; B65D 51/04

[52] U.S. Cl. ..... 220/331; 220/346

[58] Field of Search ..... 220/331, 345, 346, 379

[56] References Cited

U.S. PATENT DOCUMENTS

| | | | |
|---|---|---|---|
| 4,048,050 | 9/1977 | Hillman | 220/331 X |
| 4,119,240 | 10/1978 | Dumas et al. | 220/331 |

*Primary Examiner*—George T. Hall

*Attorney, Agent, or Firm*—Hill, Van Santen, Steadman, Chiara & Simpson

[57] ABSTRACT

A cover of the transport container is rotatably seated by means of two pegs each guided in a respective slot of the transport container side walls and can also be entirely removed from the transport container by means of the longitudinal displacement of said cover.

12 Claims, 5 Drawing Figures

BOX-TYPE TRANSPORT CONTAINER OF AN ELECTRICALLY DRIVEN TRANSPORT CAR WITH A LOCKABLE COVER

BACKGROUND OF THE INVENTION

The invention relates to a box-type transport container of an electrically driven transport car with a lockable cover which when seated in closing relation to the container exhibits lateral faces or side pieces extending downwardly from a covering plate and in close relation to the exterior surfaces of the walls of the transport container in the seating area.

Standard transport containers of this type exhibit a cover mounted by means of hinges and locked in the closed position by means of a latch secured to the transport container, which latch engages in a corresponding contour of the cover. For employment of such transport containers in hospitals or laboratories, the requirement is often present that the transport container be capable of being so thoroughly cleaned and disinfected after a single or multiple use that a specified limit number of remaining living germs on the transport container is not exceeded, such limit varying according to the stringency of the needs of the individual organization. It has been demonstrated in practice that this requirement often cannot be fulfilled with the employment of hinges, rotatable latches or other contours which form spaces that are difficult to reach during cleaning and disinfecting.

SUMMARY OF THE INVENTION

The object underlying the invention consists of designing the initially cited box-type transport container in such manner that an impeccable cleansing and disinfecting of the transport container, as demanded by hospitals and laboratories, is possible without excessive outlay. This object is achieved in that the cover is seated against the walls by means of two pegs arranged in axial alignment with one another at a side or end of closure region (here termed the rear area) and each guided in a respective slot in such manner that, after releasing the locking means, the cover can be rotated by approximately 90° in conjunction with a relative movement between each peg and slot in the longitudinal direction of the slot and is positively locked in this position by means of the abutting of the cover against a rear wall of the transport container and the abutting of the pegs against the contour of the slots. In such a construction, the lateral faces can be located either along the longer sides or along the shorter sides of a rectangular cover.

The particular advantage of the invention can be seen in that the seating of the cover ensues in such manner that, on the one hand, the cover can be removed from the transport container for cleaning and disinfection without difficulty; and, on the other hand, after removing the cover, the parts of the transport container serving for the seating of said cover are easily accessible for a subsequent cleaning and disinfection; further, upon loading or, respectively, unloading of the transport container, the cover need not be completely removed from the transport container but rather can be opened and closed by means of a ninety degree rotation, for example.

In the construction just described, the rotational movement is accommodated by means of pegs conducted in slots; however, the slots need not absolutely involve the entire thickness of the walls of the transport container or the entire thickness of the lateral faces of the cover, but rather can also be designed in the form of grooves or can be designed by means of channels formed by means of projecting lateral bars.

The stable open position for the cover achieved in the usual embodiments of pivot bearings for the covers of transport containers by means of a corresponding design of the rotating seating can also be achieved in the inventive transport container by means of a corresponding design of the rotating seating. For example, according to an advantageous embodiment of the invention, this can occur in that, after rotating the cover, the interior surface of the rear area of the covering plate abuts against the exterior surface of the adjoining rear wall of the container body and in that the slots exhibit a blocking edge against which the pegs abut after rotation in the sense of a positive lock. Such a blocking edge can be produced, for example, by means of a rectangular enlargement in the slot into which the peg falls after the rotation of the cover. An inadvertent tripping of the peg out of the rectangular enlargement can be avoided in that the rear edge of each rectangular enlargement of the slot rises obliquely in the direction toward the front wall; a further possibility for preventing the inadvertent slipping of the peg out of the slot can ensue by means of an acute bending of a rectangular tab formed by material folded back to form the rectangular enlargement of each slot.

A preferred embodiment of the inventive box-type transport container, however, provides that the outer surface of the end area of the covering plate abuts against the interior surface of the rear wall after the rotation of the cover.

In this embodiment, the cover is designed in such manner or, respectively, seated in such manner that the surface of the rear area of the covering which is directed outwardly dips into the transport container; an inadvertent displacement of the rotated cover within the transport container is prevented by means of the limitation of the displaceability of the pegs within the slots. The design of the cover preferably ensues in such manner that a respective slit or notch at each side of the cover at its rear area has a width corresponding at least to the thickness of the associated side wall of the transport container and is located in the transition zone between the covering plate and the lateral faces or side pieces of the cover, so that the upper edges of the side walls can extend into such notches in the open position of the cover. The cover in open position thus terminates the clear opening of the transport container with the rear edge of the cover essentially flush against the rear wall of the container, and with the side walls of the transport container not quite completely extending into the notches existing between the covering plate and the side pieces. However, the positive lock (requiring initial upward movement of the cover in its open position) can also be achieved where the cover rests with the bottoms of the notches on the upper edges of the side walls of the transport container in the open position of the cover.

An advantageous further development of the invention provides that the second end area (or front) of the cover is seated by means of two pegs arranged in axial alignment with one another and conducted in a respective slot. A rotation of the cover around the pegs at the rear area of said pegs is thus only possible when the pegs arranged in the second end area (or front) have been guided out of the allocated slots.

The rotation of the cover during the transport of the transport container is prevented by means of a locking installation. It is to be viewed as expedient to provide this locking installation on the front wall of the transport container lying opposite the rotating seating of the cover. To that end, it is to be viewed as expedient to allow the rotation of the cover only in the area of the one side face (here termed the rear of the cover for convenience) and to exploit the front side lying opposite thereto for the locking.

The limitation of the rotatability to one end area of the cover despite the presence of like seatings in both end areas of the cover may be achieved in that the lengths of the slots and/or the position of the pegs is adapted to one another in the two end areas in such manner that, upon pushing the non-rotated cover, only the pegs of the second end area (here termed the front area for convenience) in the initial operation can be conducted out of the appertaining slots. The adjustment of the seatings respectively formed of two pegs and two slots in both end areas of the cover thereby preferably ensues in such manner that the slots in a first end area are longer than the slots in the second end area.

The necessary locking of the cover is advantageously achieved in that a locking bar preventing a forward shifting and thus preventing rotation of the cover is seated on the second or front wall which lies opposite the first or rear wall.

It is already known—German Utility Model No. 76 12 348—to monitor the locking state of the cover of box-type transport containers of electrically driven transport cars. This occurs in such manner that the locking installation contains a contacting installation which is actuated when the cover is locked. This monitoring of the locking state can be achieved in the inventive box-type transport container upon providing the locking bar on the front wall in such manner that the locking bar is designed as the actuating element of a contact installation monitoring the locking state of the cover. To that end, the locking bar expediently exhibits a projection which is arranged and designed in such manner that a continuous actuation of the contact installation by means of the locking bar is only possible when the cover is in place. In such lockings, transitional positions generally occur in which, for example, the locking bar has already been pressed down by means of the cover but the locking bar does not yet abut against the front edge of the cover and, thus, no secure locking exists. In this conjunction, an advantageous further development of the invention provides that the cover exhibits a spring in the second end (front) area which spring displaces the cover in the non-locked state to such a degree that the pegs of the second end area lie outside of the appertaining slots. When the locking bar does not yet abut against the front of the cover, the cover is displaced to such a degree that the locking bar—spring seated for this purpose—lifts it up and the contact actuation is thus again broken.

In the following, the invention is explained in greater detail on the basis of a sample embodiment illustrated in the accompanying sheets of drawings; and other objects, features and advantages will be apparent from this detailed disclosure and from the appended claims.

DETAILED DESCRIPTION

Figure 1:
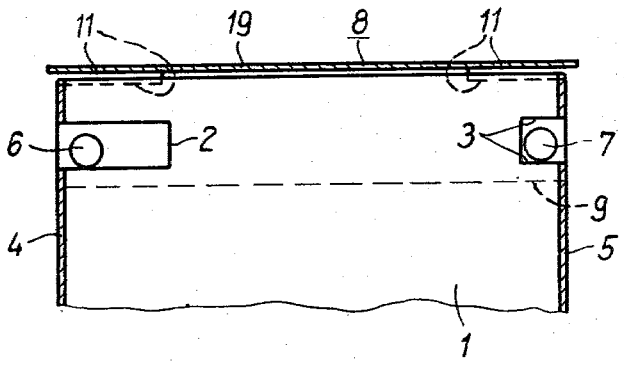
FIGS. 1 through 4 each represent a longitudinal section through a box-type transport container with the cover disposed in four different positions.

It can be seen from FIGS. 1 through 4 that two slots 2 and 3 are provided in each side wall such as 1 of the transport container, which slots affect the rear and front walls 4 and 5 of the transport container at least in such degree that the introduction of axially aligned pegs such as 6 and 7 of a cover 8 first into slots such as 2, and then into slots such as 3 is rendered possible. The cover 8 exhibits opposite lateral faces lying outside of the side walls such as 1 of the transport container, one face 9 being indicated in FIGS. 1 through 4, and has notches 11 in the end areas of the cover 8 which separate the actual covering plate 10 from the side faces 9.

FIG. 1 shows the closed position of the cover in which the pegs such as 6 and 7 of the cover 8 lie in the slots such as 2 and 3. The removal of peg 6 from slot 2 by rearward movement is prevented by means of the abutment of peg 7 against the vertical end edge of slot 3. The front-end removal of peg 7 from slot 3 is prevented by means of a locking bar not visible in FIGS. 1 through 4, but indicated at 12, 17 in FIG. 5.

Figure 2:
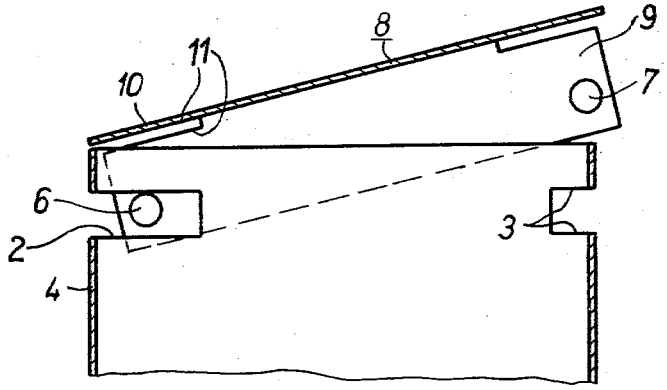

FIG. 2 illustrates a possible first phase of the rotational movement of the cover 8 after releasing the locking bar. In this phase, the cover 8 has first been moved to the right so that pegs such as 7 come to lie outside of the associated slots such as 3 and, thus, an upward rotational movement is rendered possible. If the rotational movement is continued from the position illustrated in FIG. 2, the left end edge 10*a* (which may be termed the rear edge) of the covering plate 10 would strike against the upper edge of the end wall 4.

Figure 3:
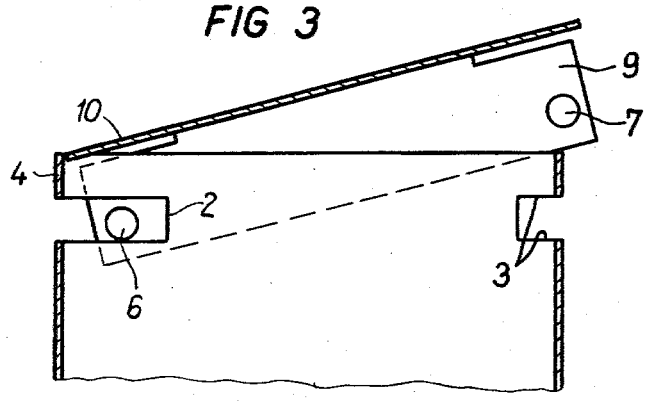

A further rotation from the position shown in FIG. 2, therefore, requires the further displacement of peg 6 within slot 2 as illustrated in FIG. 3 until the left limitation edge of the covering plate 10 lies in front of the end-wall 4 of the transport container.

Figure 4:
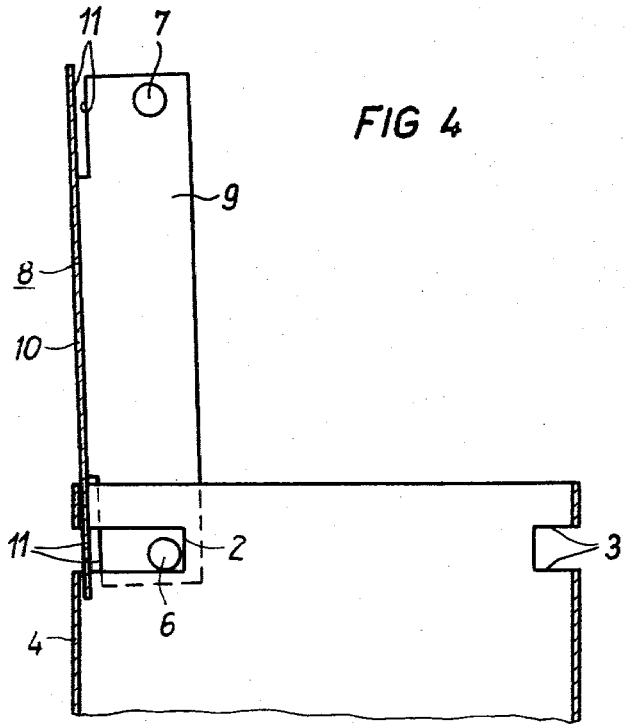

Subsequently, the cover 8 can be rotated until it is in the position illustrated in FIG. 4, in which it is positively locked by means of the abutment of the surface of the covering plate 10 which is directed outwardly against the surface of the end wall 4 which is directed toward the interior and by means of the retention of pegs such as 6 in slots such as 2.

In a subsequent closing movement, the same rotational and displacement motions as illustrated in FIGS. 1 through 4 are carried out in the reverse sequence. It may be required to lift the cover vertically from the position shown in FIG. 4 as permitted by the height of the slots such as 2, before downward rotation of the cover can be effected.

Figure 5:
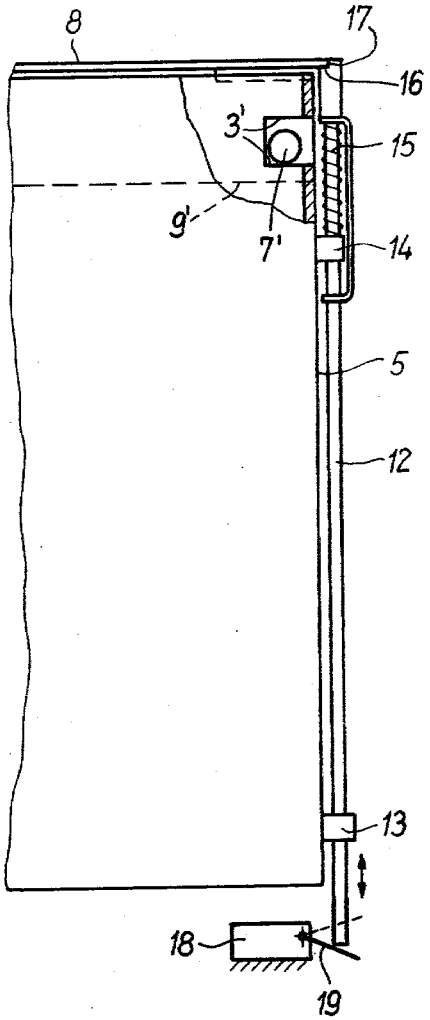
FIG. 5 illustrates the seating and function of a locking bar affecting the cover.

FIG. 5 illustrates the area of the front wall 5 of the transport container. Since FIG. 5 is a partial elevational view, peg 7' axially aligned with peg 7 of FIG. 1 is shown in its associated slot 3'. Thereby, the cover 8 is in the locked position and is secured in this position against forward shifting movement by means of the locking bar 12. The locking bar 12 is conducted in the two bearings 13 and 14 so that it can be longitudinally displaced and is connected with a spring 15 in the area of the bearing 14 which spring presses the locking bar 12 in the direction toward the cover 8. The locking bar 12 exhibits a horizontal edge face 16 at its upper end area on which a front edge area of the cover 8 rests. A vertical locking edge face 17 rising vertically from the edge face 16 prevents a horizontal displacement of the cover 8 in the forward direction. The cover 8 can only be opened after a preceding removal of the locking bar 12 from the bearings 13 and 14.

In the bottom area of the transport container, the locking bar 12 strikes against a contact installation indicated at 18 arranged in the driving carriage—not illustrated—for the transport container.

For the sake of a specific example, switch 18 is shown with an actuating button 19 which is held depressed by means of a projection 12*a* on locking bar 12 in the locked position of the cover 8 as shown in FIG. 5. In an exemplary embodiment, for example, bearings 13 and 14 may have removable parts 13*a* and 14*a* which can be detached to allow removal of the locking bar 12 from the bearing portions 13*b* and 14*b* secured to the front wall 5 of the container. If the locking bar is then reassembled with bearings 13 and 14 with the cover 8 removed, the clearance of bracket 20 at its lower end 20*a* relative to bracket 14 may be such that projection 12*a* will be above actuating button 19 so that the switch of installation 18 is non-actuated. On the other hand if the undersurface of cover 8 rests on the uppermost edge face 21 of bar 12 with the cover 8 pressed downwardly as far as possible, the projection 12*a* will be below actuating button 19 so that the switch of installation 18 will again be in the non-actuated position.

The foregoing description under the heading Summary of the Invention is hereby specifically incorporated in this detailed description as applicable to the illustrated embodiment with the modifications explained therein, and the various features of each of the embodiments of the specification and claims are hereby disclosed as applicable to each of the other embodiments herein.

It will be apparent that many modifications and variations may be effected without departing from the scope of the novel concepts and teachings of the present invention.

We claim as our invention:

1. A box-type transport container of an electrically driven transport car with a lockable cover which exhibits lateral side pieces depending from a covering plate and overlapping exterior surfaces of the walls of the transport container in the seating area, characterized in that the cover (8) is seated against the wall (1) by means of two pegs (6) arranged in alignment with one another and guided in a respective slot (2) in such manner that, after releasing the locking, the cover (8) is rotated by approximately 90° in conjunction with a relative motion between pegs (6) and slots (2) in the longitudinal direction of the slots (2) and is positively locked in this position by means of the abutment of the cover (8) against an end area of the transport container and abutment of the pegs (6) against the contour of the slots (2).

2. A box-type transport container according to claim 1, characterized in that the pegs (6) are arranged on the lateral side pieces (9).

3. A box-type transport container according to claim 1, characterized in that, after the rotation of the cover (8), the exterior surface of the end area of the covering plate (10) abuts against the interior surface of the end wall (4).

4. A box-type transport container according to claim 1, characterized in that a respective notch (11) with a width corresponding at least to the thickness of the side wall (1) of the transport container is provided in the end area of the cover (8) in the transitional zone between the covering plate (10) and the lateral side pieces (9).

5. A box-type transport container according to claim 4, characterized in that, in the open position, the cover rests on the end wall of the transport container with the bottoms of its notches (11).

6. A box-type transport container according to claim 1, characterized in that, after rotation of the cover, the interior surface of a first end area of the covering plate abuts against the exterior surface of the end wall and the slots exhibit a blocking edge against which the pegs abut after rotation, in the sense of a positive lock.

7. A box-type transport container according to claim 1, characterized in that a second end area of the cover (8) is seated by means of two pegs (7, 7') arranged in alignment with one another and guided in a respective slot (3, 3').

8. A box-type transport container according to claim 7, characterized in that the length of the slots (2, 3) and/or the position of the pegs (6; 7, 7') in both end areas are adapted to one another in such manner that only the pages (7, 7') of the second end area can be removed from the appertaining slots (3, 3') upon displacement of the non-rotated cover (8).

9. A box-type transport container according to claim 7, characterized in that the slots (2) in a first end area are dimensioned longer than the slots (3, 3') in the second end area.

10. A box-type transport container according to claim 1, characterized in that a locking bar (12) preventing a rotation of the cover (8) is seated on a second end wall (5) lying opposite an end wall (4) allocated to the end area.

11. A box-type transport container according to claim 10, characterized in that the locking bar (12) is designed as an actuating element of a contact installation monitoring the locked state of the cover (8).

12. A box-type transport container according to claim 11, characterized in that the cover exhibits a spring in the second end area which spring displaces the cover in the non-locked state to such a degree that the pegs of the second end area lie outside of the appertaining slots.

* * * * *